US006745989B2

(12) United States Patent
Domasin

(10) Patent No.: US 6,745,989 B2
(45) Date of Patent: Jun. 8, 2004

(54) CARD HOLDER

(76) Inventor: Ricardo G. Domasin, 720 W. Kenneth Rd., Glendale, CA (US) 91202

( * ) Notice: Subject to any disclaimer, the term of this patent is extended or adjusted under 35 U.S.C. 154(b) by 0 days.

(21) Appl. No.: 10/279,460

(22) Filed: Oct. 24, 2002

(65) Prior Publication Data

US 2003/0213887 A1 Nov. 20, 2003

Related U.S. Application Data

(60) Provisional application No. 60/381,648, filed on May 17, 2002.

(51) Int. Cl.[7] ..... A47B 23/00

(52) U.S. Cl. ..... 248/465.1; 248/175; 248/453; 40/658; 40/764

(58) Field of Search ..... 248/488, 455, 248/447, 316.7, 231.81, 451, 465.1, 441.1, 175, 473, 453; 281/33; D19/90, 86; D21/392, 393; D20/43; D6/313; 40/124.09, 745, 124.12, 124.14, 751, 761, 658, 611.2, 764

(56) References Cited

U.S. PATENT DOCUMENTS

| | | | | |
|---|---|---|---|---|
| 555,249 | A | * | 2/1896 | Koller |
| 738,763 | A | | 9/1903 | Boden |
| 1,086,906 | A | * | 2/1914 | Felten |
| 1,194,016 | A | * | 8/1916 | Harford |
| 1,321,592 | A | * | 11/1919 | Brown |
| 1,621,754 | A | | 3/1927 | Rommel |
| 1,811,124 | A | * | 6/1931 | Greeley |
| 1,812,318 | A | | 6/1931 | Bower |
| 2,532,487 | A | * | 12/1950 | Faulkner |
| D169,903 | S | * | 6/1953 | Hawkinson |
| 3,086,658 | A | | 4/1963 | Palmer |
| 3,791,651 | A | | 2/1974 | Barnum et al. |
| 4,002,240 | A | * | 1/1977 | Dorn ..... 211/42 |
| 5,012,937 | A | | 5/1991 | Owens |
| D330,473 | S | | 10/1992 | Lemire |
| 5,727,696 | A | | 3/1998 | Valiulis |
| 5,901,859 | A | | 5/1999 | Carr et al. |
| 6,227,504 | B1 | * | 5/2001 | Seaberg ..... 248/174 |

FOREIGN PATENT DOCUMENTS

| | | | | |
|---|---|---|---|---|
| EP | 0551087 A1 | * | 7/1993 | ..... B42F/13/40 |
| GB | 2379634 A | * | 3/2003 | ..... A47F/1/14 |
| JP | 2003-107999 | * | 9/2001 | ..... G09F/1/10 |

OTHER PUBLICATIONS

R3 Engraving & Signs, Marble Desk Bar & Card Holder, #928–902 copy right 1996, 1997 for all photos and text.*

Netique, Business Cards, photography copyright 1996–2003.*

* cited by examiner

*Primary Examiner*—Gwendolyn Baxter
(74) *Attorney, Agent, or Firm*—Christie, Parker & Hale, LLP

(57) ABSTRACT

A card holder for supporting or retaining a card such as a greeting card is provided. In one exemplary embodiment, the card holder has two holding portions each for accommodating a portion of a card. In another exemplary embodiment, the card holder has a first leg extending from a second leg. The card holder is mounted over a card having two legs such that the card first leg is adjacent to the card holder first leg and the card second leg is adjacent to the card holder second leg. The card holders of the present invention may also accommodate signs or ornaments.

8 Claims, 5 Drawing Sheets

CARD HOLDER

CROSS-REFERENCE TO RELATED APPLICATION

This application is based upon and claims priority on U.S. Provisional Application Serial No. 60/381,648 filed on May 17, 2002, now abandoned the contents of which are fully incorporated herein by reference.

BACKGROUND

The present invention generally relates to a device for holding an article that is to be displayed on a surface, and more particularly, to a card holder for holding a card in an upright position.

Articles, such as greeting cards, are generally displayed on surfaces, for example, desks or countertops, for their aesthetics and sentimental value. Cards, such as greeting cards, are commonly supported on a surface by opening the faces of the card to form a pair of "legs" that rest on the surface to hold the card upright. The legs are retained in a substantially V-shaped relation by frictional forces between the surface and the thin edges of the card faces. Since the frictional surface area between the sides of the card faces and the surface is minimal, the greeting cards often open or fall flat on the surface as a result of gravitational forces, or sudden movement of the supporting surface.

Thus, there is a need for a simple and cost effective device for preventing these articles from opening or falling flat on their supporting surfaces while being displayed.

SUMMARY OF THE INVENTION

The present invention is a device for holding an article displayed on a supporting surface. Specifically, in an exemplary embodiment, a card holder is provided which supports a greeting card. In one exemplary embodiment, the card holder is a unitary member comprising two substantially channel shaped holding portions interconnected by a transverse portion. The holding portions form channels for a corresponding leg of the greeting card such that the holder retains the greeting card in an open standing position.

In another exemplary embodiment the card holder comprises a first leg extending from a second leg. A card having a first leg extending from a second leg is positioned within the card holder, i.e., the card holder is positioned over such card, such that the card holder first leg is adjacent the card first leg and the card holder second leg is adjacent the card second leg so as to prevent the card first leg from pivoting further apart from the card second leg.

A sign or ornament may be mounted on any card holder of the present invention.

BRIEF DESCRIPTION OF THE DRAWINGS

The drawings describing the present invention are as follows.

DETAILED DESCRIPTION OF THE INVENTION

Figure 1:
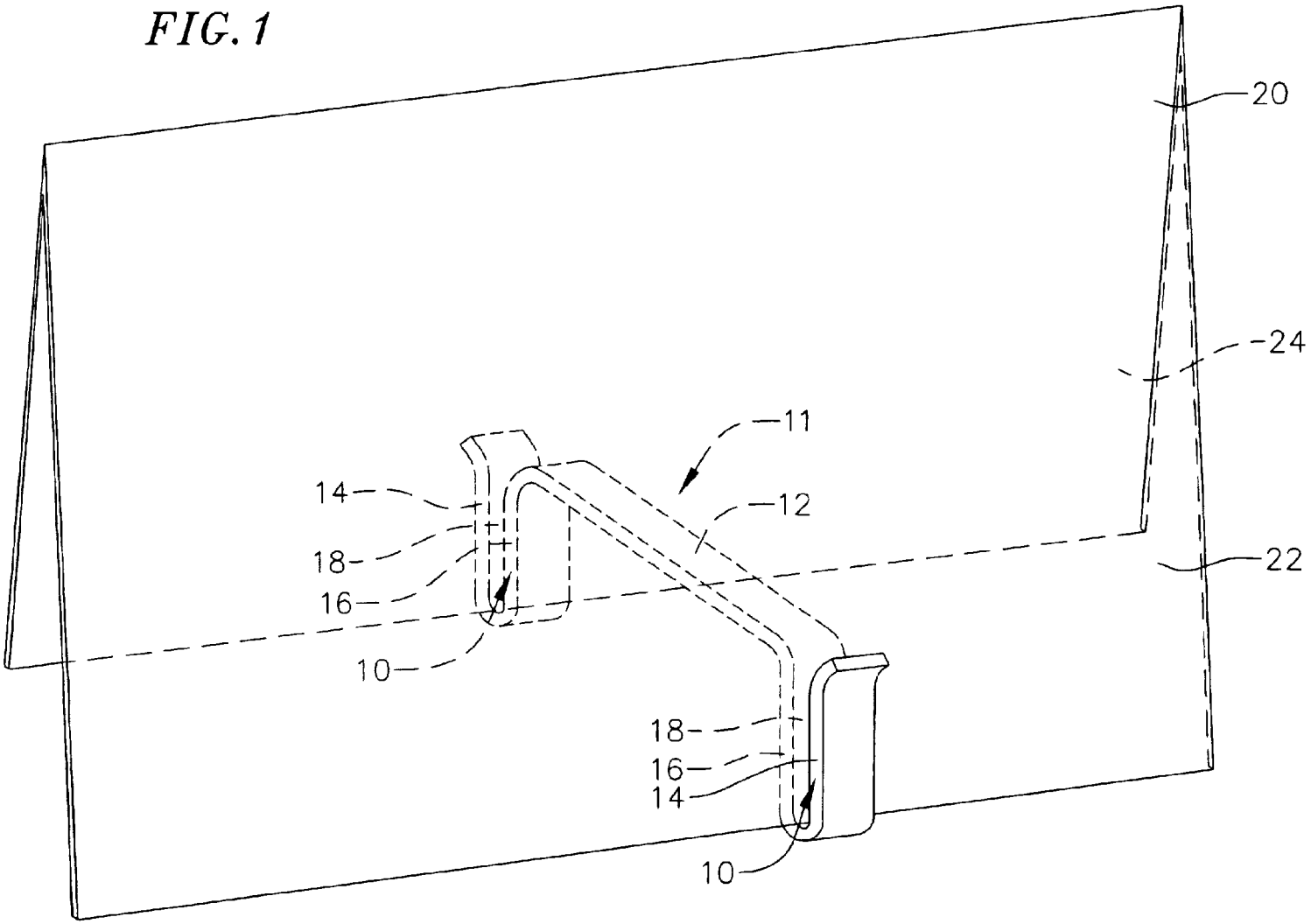
FIG. 1 is perspective view of card shown in dashed lines supported by an exemplary embodiment card holder of the present invention.

The present invention is generally related to a card holder for holding an article that is to be displayed on a surface 1, such as a table top. Specifically, in the exemplary embodiment shown in FIG. 1 the card holder 11 supports a card 20 such as a greeting card about the greeting card legs 22 and 24 in an upright or generally V-shaped open standing position.

The card holder is a unitary member comprising two substantially channel shaped holding portions 10 interconnected by a transverse portion 12 as shown in FIGS. 1, 2A, 2B and 6. The holding portions are folded onto themselves in such a way that each holding portion has a first leg 14 opposite a second leg 16 forming a channel 18 therebetween. The term "card" as used herein refers to any leaf of paper or relatively flat thin material as for example, a greeting card or a business card.

Figure 6:
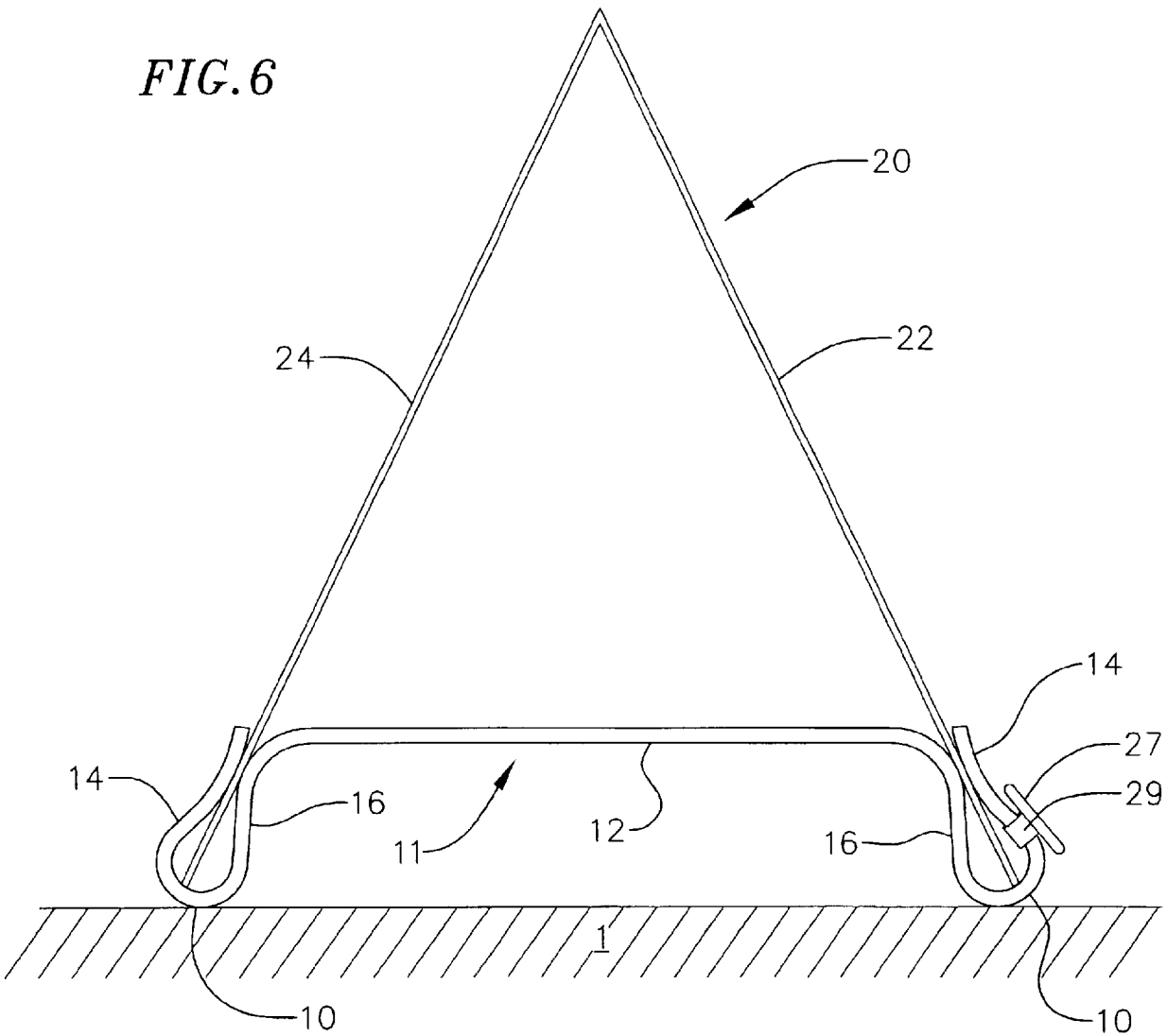
FIG. 6 is an end view of an exemplary embodiment card holder supporting a card and having an ornament or sign mounted thereon.

The card 20 is generally positioned within the card holder with each leg 22 and 24 of the card fitted within a respective channel 18 of the holding portions of the card holder such that the card holder retains the card in an open standing position as shown in FIGS. 1 and 6. Preferably, the legs 14 and 16 defining each channel 18 should be positioned very close together, or in an abutting relationship to each other, so that they provide a pinching or clipping force on each leg of the card. Once the card legs are mounted in the holder, the the holder prevents the card from opening or falling flat on the surface on which is stands.

In an exemplary embodiment, when the legs of the card are mounted or fitted in the holding portions of the card holder, the holding portions clip on the card legs. The card holder may have its holding portions clipped on the base as shown in FIGS. 1 and 6 or the side edges of the card legs for retaining the card in an open standing position.

The card holder may be made from various materials such as plastic, metal or wire as for example, stainless steel wire, or nickel plated steel wire. For example, the card holder may be made of the same wire that is used to form a paper clip, such as nickel plated steel wire, as for example shown in FIGS. 2A, 2B and 6. A typical wire used may for example be 0.032 to 0.0625 inch in diameter. Further, the card holder may be colored for aesthetics or covered by a material as for example a plastic material that may be colored.

Figures 2A, 2B:
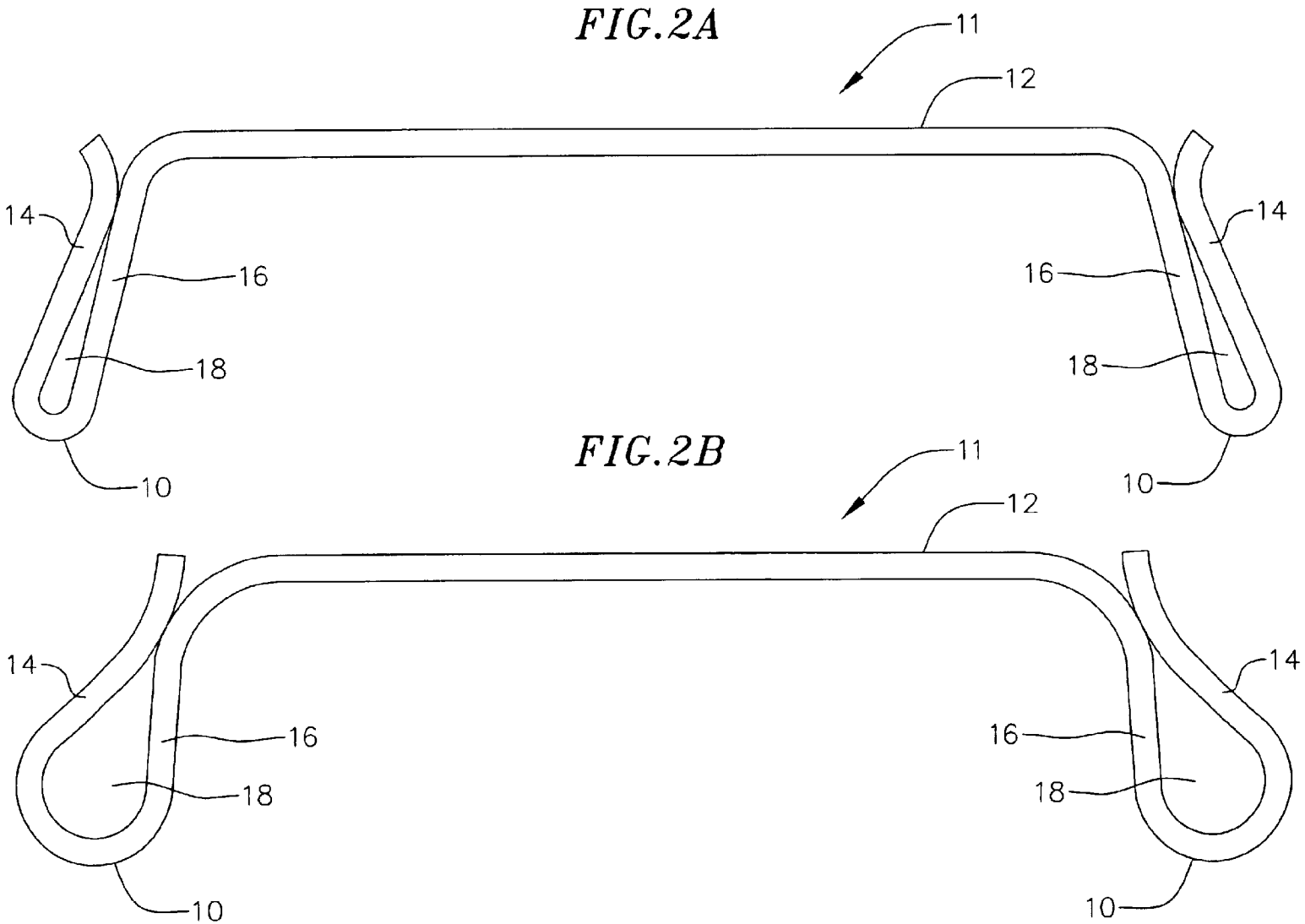
FIGS. 2A and 2B are respective front views other exemplary embodiment card holders of the present invention.

For example, in the exemplary embodiment shown in FIGS. 2A and 2B, the card holder is made by forming, or bending, a single piece of wire, such as a wire used to form a paper clip. Opposite end portions of the wire are bent to an angle and radius, for example, to an angle of approximately 110° and a radius of approximately 0.25 inches, to form the pair of holder portions 10 downwardly extending from the transverse portion 12. The holder portions are folded onto themselves to a specified radius, for example, to a radius of approximately 0.156 inches, to form the pair of integral legs 14 and 16 defining a channel 18 therebetween. The free ends of legs 14 and/or 16 may be arcuate such that a portion of the legs 14 and 16 are positioned in close proximity, or abutting each other, to provide a pinching or clipping force for retaining the legs of the card. In the exemplary embodiment, the two legs of each holder portion define a clip therebetween for clipping on a card. In an exemplary embodiment, once the legs 22, 24 of a card are fitted in the holder portions of the exemplary embodiment card holders shown in FIGS. 2A and 28, the card holder retains the position of the card while the card supports the card holder in an upright position, i.e., with the legs of each holder sandwiching a card leg.

Figure 3:
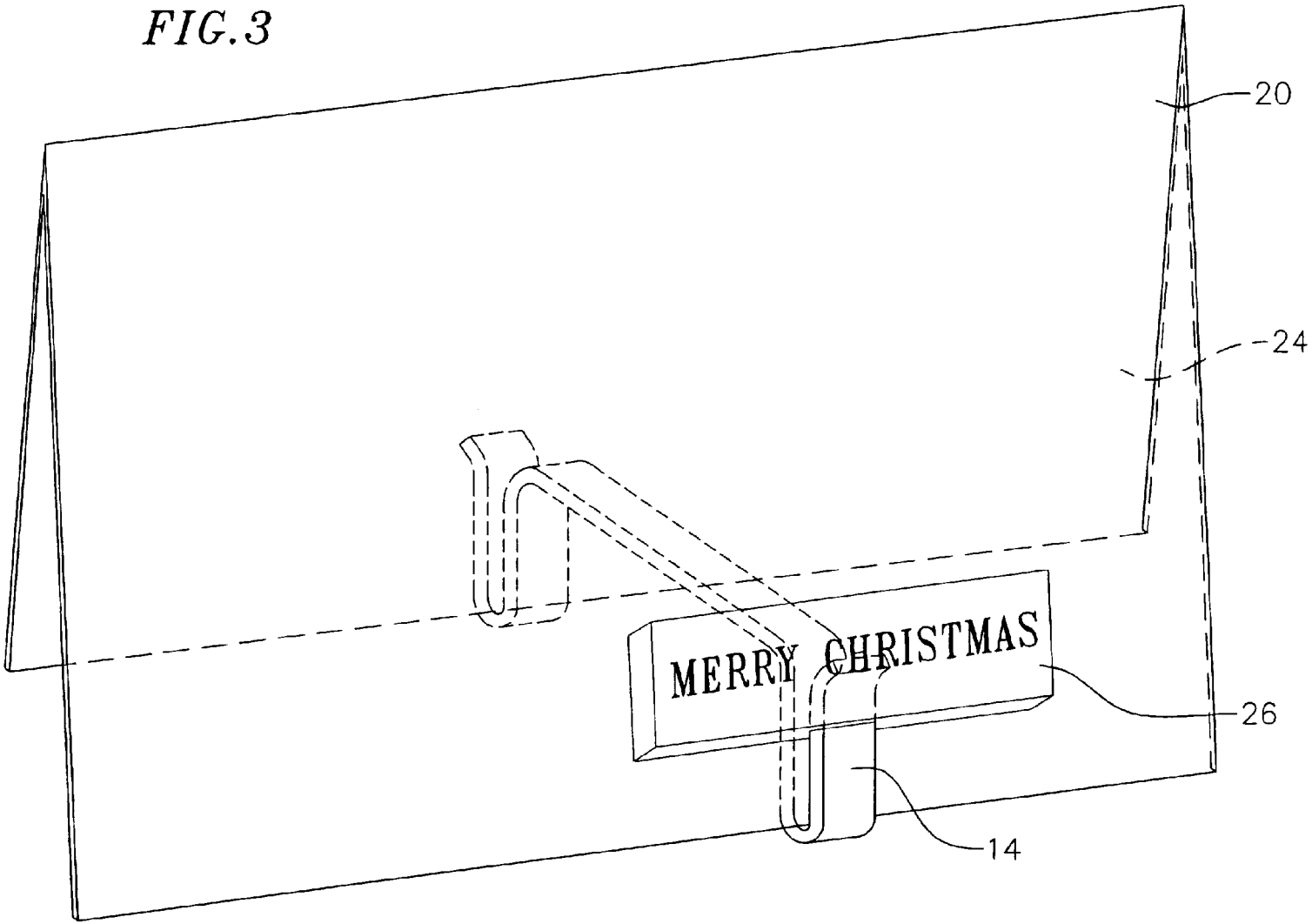
FIG. 3 is perspective view of a card shown in dashed lines supported by the card holder shown in FIG. 1 where the card holder also supports an ornament or sign.

In an alternate exemplary embodiment, one of the legs 14 may accommodate an ornament or a sign 26 as for example shown in FIG. 3 that may display a message or a symbol. In the exemplary embodiment shown in FIG. 3, a leg 14 of the card holder penetrates the ornament or sign for holding the ornament or sign in place. In another exemplary embodiment, shown in FIG. 6, an ornament or sign 27 has a ring 29 that is penetrated by one the legs 14 of the card holder.

Figure 4:
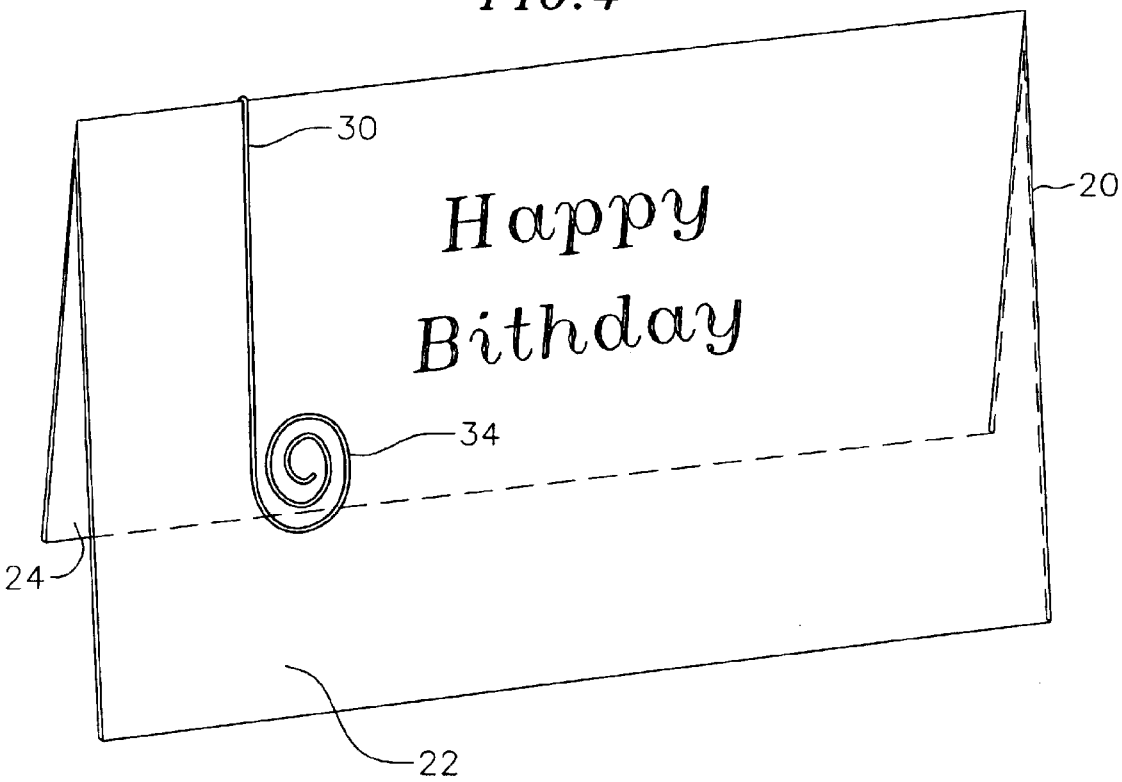
FIG. 4 is a perspective view of a card supported by another exemplary embodiment card holder of the present invention.
Figure 5:
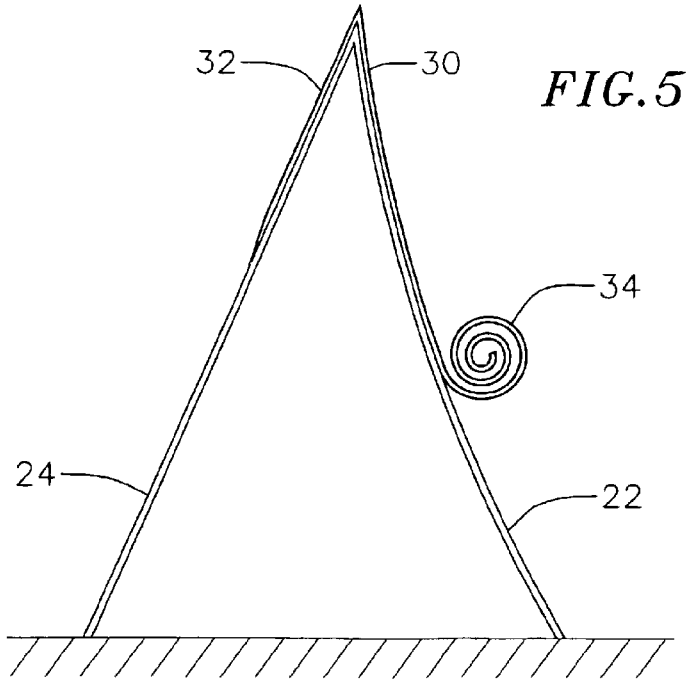
FIG. 5 is an end view of the card holder with card shown in FIG. 4.

In a further exemplary embodiment, as shown in FIGS. 4 and 5, the card holder may comprise a pair of legs 30 and 32 in a substantially V-shaped arrangement. In accordance with this embodiment, the card is fitted between the legs 30 and 32 of the card holder such that each leg of the card is adjacent to each leg of the card holder. In this regard, the card is held in an open standing position. In other words, a V-shaped portion of the card formed by the two legs of the card is fitted within the V-shaped card holder. In this regard, the card holder limits the amount one leg of the card can open relative to the other leg so as to hold the card in an open standing position. A hook 34 may be formed at the end of at least one the legs to hold an ornament or a sign.

In other exemplary embodiments, the end portions of the holding portions, as for example, the legs 14 (FIGS. 2A and 2B) or the end portion of a card holder of the embodiment shown in FIG. 4 may be shaped to a desired design or ornamental shape.

As can be seen, the card holders of the present invention are very simple to make and inexpensive to mass produce.

While the present invention is described as a holder for cards, persons skilled in the art would recognize that the holder may be used to support various lightweight articles equivalent to a card in size and construction. Furthermore, although the present invention has been described and illustrated to respect the exemplary embodiments thereof, it is to be understood that it is not to be so limited, since changes and modifications may be made therein which are within the full intended scope of this invention as hereinafter claimed.

What is claimed is:

1. A card holder and card combination comprising:

a card having a first leg portion extending transversely from a second leg portion; and a card holder comprising a first holder portion spaced apart from a second holder portion, and a transverse portion interconnecting the first and second holder portions, wherein each holder portion comprises a first leg extending from the transverse portion and a second leg opposite the first leg and extending from the first leg toward the transverse portion defining a space between the first and second legs, wherein the second leg is angled at an angle not perpendicular to the transverse portion wherein the first leg portion of the card is received between the first and second legs of the first holder portion and the second leg portion of the card is received between the first and second legs of the second holder portion, wherein the card holder is unitarily formed from a wire-type material.

2. A combination as recited in claim 1 wherein the first holder portion clips on the first leg portion of the card.

3. A combination as recited in claim 2 wherein the second holder portion clips on the second leg portion of the card.

4. A combination as recited in claim 1 wherein the card second leg portion is angled relative to the card first leg portion, wherein the card second leg portion can pivot relative to the card first leg portion and wherein the card holder prevents the second portion from pivoting relative to the first card portion.

5. A combination as recited in claim 1 wherein the card holder is unitarily formed from a single piece of wire.

6. A combination as recited in claim 1 wherein the card holder supports the card in an upright position.

7. A combination as recited in claim 1 further comprising an ornament or sign mounted on at least one of said holder portions.

8. A combination as recited in claim 1 wherein the card is V-shaped having an vertex, wherein the first leg portion has a first base end opposite the vertex and wherein the second leg portion has a second base end opposite the vertex, and wherein the first base end is received between the first and second legs of the first holder portion and the second base end is received between the first and second legs of the second holder portion.

* * * * *